US009746249B2

(12) United States Patent
Lee

(10) Patent No.: US 9,746,249 B2
(45) Date of Patent: Aug. 29, 2017

(54) HEAT PIPE STRUCTURE

(71) Applicant: Asia Vital Components Co., Ltd., New Taipei (TW)

(72) Inventor: Sung-Wei Lee, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 197 days.

(21) Appl. No.: 14/538,816

(22) Filed: Nov. 12, 2014

(65) Prior Publication Data

US 2016/0131435 A1 May 12, 2016

(51) Int. Cl.
*F28D 15/00* (2006.01)
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC ..... F28D 15/00; F28D 15/04; F28D 15/043; F28D 15/046; F28F 1/022; H01L 23/427
USPC ..... 165/140.14, 104.19, 104.21, 104.26, 165/104.33
See application file for complete search history.

(56) References Cited

U.S. PATENT DOCUMENTS 3,618,660 A * 11/1971 Busse ..... F28D 15/04 165/104.14
4,899,810 A * 2/1990 Fredley ..... B64G 1/506 165/104.14
4,909,313 A * 3/1990 Voss ..... F28F 13/00 165/46
4,909,316 A * 3/1990 Kamei ..... F28D 15/04 122/33
5,046,553 A * 9/1991 Lindner ..... F28D 15/046 122/366
7,051,794 B2 * 5/2006 Luo ..... F28D 15/0233 165/104.26
7,891,413 B2 * 2/2011 Liu ..... F28D 15/046 165/104.21
2002/0179288 A1 * 12/2002 Ishida ..... B21C 37/151 165/104.26
2003/0183372 A1 * 10/2003 Lai ..... F28D 15/04 165/104.26

(Continued)

FOREIGN PATENT DOCUMENTS

CN 1707784 A 12/2005

*Primary Examiner* — Len Tran
*Assistant Examiner* — Gustavo Hincapie Serna
(74) *Attorney, Agent, or Firm* — C. G. Mersereau; Nikolai & Mersereau, P.A.

(57) ABSTRACT

A heat pipe structure includes a first tubular body and a second tubular body. The first tubular body has a first receiving space. A first working fluid is contained in the first receiving space. The second tubular body is disposed in the first receiving space. The second tubular body has a second receiving space. A second working fluid is contained in the second receiving space. The solidification temperature of the first working fluid is different from the solidification temperature of the second working fluid so that the heat pipe structure can be activated at low temperature to keep operating at normal temperature to enhance the performance. Moreover, the assembly applicability is enhanced to lower the assembling cost.

7 Claims, 5 Drawing Sheets

(56) References Cited

U.S. PATENT DOCUMENTS

| | | | | |
|---|---|---|---|---|
| 2008/0105405 | A1* | 5/2008 | Hsu | F28D 15/046 165/104.26 |
| 2012/0055660 | A1* | 3/2012 | Walker | B21D 53/06 165/172 |
| 2012/0227935 | A1* | 9/2012 | Huang | B21D 39/04 165/104.26 |

* cited by examiner

HEAT PIPE STRUCTURE

BACKGROUND OF THE INVENTION

1. Field of the Invention

The present invention relates generally to an improved heat pipe structure, and more particularly to a heat pipe structure, which can be activated at low temperature to keep operating at normal temperature to enhance the performance. Moreover, the assembly applicability is enhanced to lower the assembling cost.

2. Description of the Related Art

A heat pipe has an evaporation end and a condensation end and has an internal vacuumed chamber. A working fluid is contained in the chamber. The chamber is in a vacuumed state so that the boiling point of the working fluid is relatively low. The heat is transferred by means of the liquid-vapor phase change of the working fluid in form of latent heat. At the evaporation end, the working fluid is evaporated to carry away a great amount of heat from a heat source in form of evaporation latent heat. The vapor of the working fluid is filled up in the vacuumed chamber and condensed into liquid at the condensation end to release heat. The liquid working fluid flows back to the evaporation section under the capillary attraction provided by the capillary structure in the chamber for the next circulation of phase change. Accordingly, the vapor-liquid circulation of is continued to effectively transfer the heat generated by the heat source to a remote end for heat exchange.

In general, the working fluid contained in the heat pipe is pure water. This is because pure water is easily available and the specific heat and latent heat in the physical properties of pure water are relatively high. That is, more heat is absorbed and carried away per unit mass. The chamber of the heat pipe is in a vacuumed state. However, this will not affect the solidification temperature of pure water. When a heat pipe with pure water serving as the working fluid is used outdoors in an environment with an environmental temperature under 0 degrees, the working fluid in the heat pipe will be solidified into ice. Under such circumstance, the working fluid will be unable to provide heat transfer effect. As a result, the temperature of the electronic device or relevant apparatus that needs heat dissipation will abruptly rise to affect the electronic components in the electronic device. This will affect the function of the electronic device or relevant apparatus or shorten the lifetime thereof.

Therefore, in general, when the heat pipe is used outdoors in an environment with an environmental temperature under 0 degrees, methyl alcohol is contained in the chamber of the heat pipe as the working fluid. However, the specific heat of methyl alcohol is lower than that of pure water. Therefore, in a normal-temperature condition, the heat conductivity or maximum heat capacity of the heat pipe with methyl alcohol as the working fluid is lower than that of the heat pipe with pure water as the working fluid. Accordingly, in order to achieve optimal heat conductivity in both normal-temperature condition and low-temperature condition, it is necessary to increase the number of the heat pipes so as to provide best heat dissipation effect. Moreover, it is often necessary to co-use both pure water heat pipe and low-temperature heat pipe. It is troublesome to assemble these heat pipes so that the assembling cost is increased. In addition, after assembled, the assembly can be hardly applied to all the devices or apparatuses. Therefore, the applicability is lowered.

According to the above, the conventional heat pipe has the following shortcomings:

1. It is hard to assembly the heat pipes.
2. The assembling cost is increased.
3. The applicability of the assembly is lowered.

SUMMARY OF THE INVENTION

It is therefore a primary object of the present invention to provide a heat pipe structure, which can be activated at low temperature to keep operating at normal temperature to enhance the performance. Moreover, the assembly applicability is enhanced to lower the assembling cost.

To achieve the above and other objects, the heat pipe structure of the present invention includes a first tubular body and a second tubular body. The first tubular body has a first receiving space. A first working fluid is contained in the first receiving space. Two ends of the first receiving space are respectively two first closed ends. The second tubular body is disposed in the first receiving space. The second tubular body has a second receiving space. A second working fluid is contained in the second receiving space. Two ends of the second receiving space are respectively two second closed ends. The solidification temperature of the first working fluid is different from the solidification temperature of the second working fluid so that the heat pipe structure can be activated at low temperature to keep operating at normal temperature to enhance the performance. Moreover, the assembly applicability is enhanced to lower the assembling cost.

The present invention has the following advantages:

1. The present invention is convenient to assemble.
2. The manufacturing cost of the present invention is lower.
3. The assembly applicability of the present invention is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
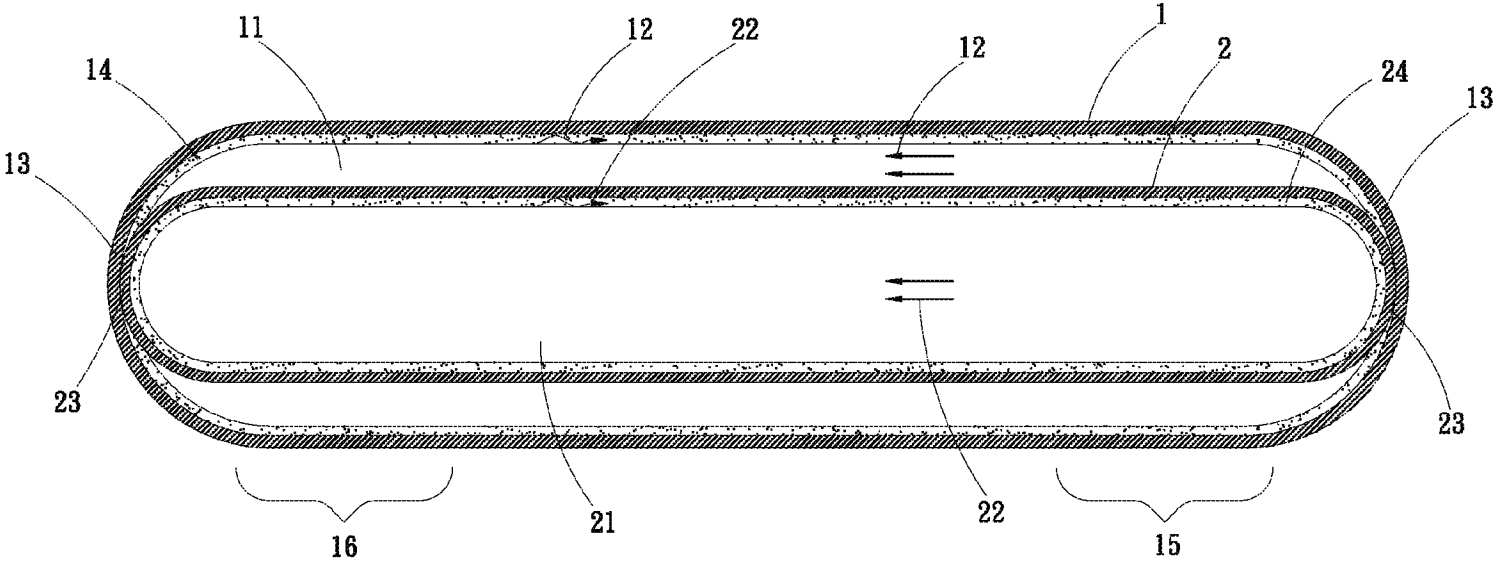
FIG. 1 is a longitudinal sectional view of a first embodiment of the present invention.
Figure 2:
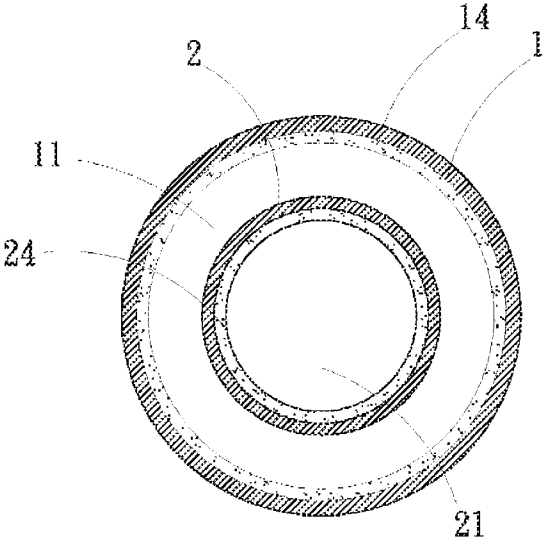
FIG. 2 is a cross-sectional view of the first embodiment of the present invention.

Please refer to FIGS. 1 and 2. FIG. 1 is a longitudinal sectional view of a first embodiment of the present invention. FIG. 2 is a cross-sectional view of the first embodiment of the present invention. According to the first embodiment, the heat pipe structure of the present invention includes a first tubular body 1 and a second tubular body 2. The first tubular body 1 has an internal first receiving space 11. A first working fluid 12 is contained in the first receiving space 11.

Two ends of the first receiving space 11 are respectively two first closed ends 13, whereby the first receiving space 11 is a vacuumed space. The first tubular body 1 has a first capillary structure 14. Two ends of the first capillary structure 14 are respectively defined as an evaporation end 15 and a condensation end 16. The first capillary structure 14 is disposed on the inner wall face of the first tubular body 1.

The second tubular body 2 is disposed in the first receiving space 11. The second tubular body 2 has an internal second receiving space 21. A second working fluid 22 is contained in the second receiving space 21. Two ends of the second receiving space 21 are respectively two second closed ends 23, whereby the second receiving space 21 is a vacuumed space. The second closed ends 23 are formed in the first receiving space 11 and connected with the first closed ends 13. The second tubular body 2 has a second capillary structure 24. Two ends of the second capillary structure 24 and the first tubular body 1 together define the evaporation end 15 and the condensation end 16 respectively. The second capillary structure 24 is disposed on the inner wall face of the second tubular body 2.

The first and second capillary structures 14, 24 are selected from a group consisting of sintered powder bodies, channeled bodies, mesh bodies and coatings. In this embodiment, the first and second capillary structures 14, 24 are, but not limited to, sintered powder bodies for illustration purposes only. In this embodiment, the first working fluid 12 is one of pure water and methyl alcohol. The second working fluid 22 is the other of pure water and methyl alcohol. However, the first and second working fluids 12, 22 are not limited to pure water and methyl alcohol.

Figure 3:
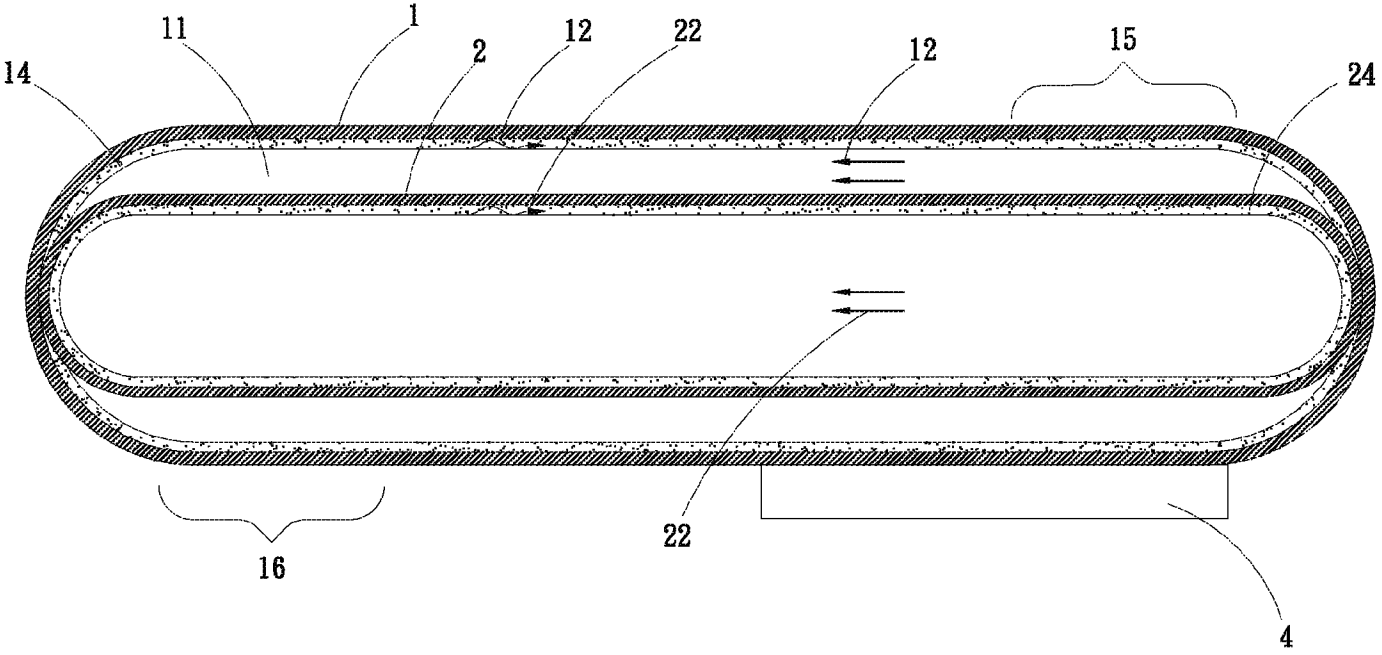
FIG. 3 is a longitudinal sectional view of the first embodiment of the present invention, showing the application thereof.

Please now refer to FIG. 3, which is a longitudinal sectional view of the first embodiment of the present invention, showing the application thereof. In this embodiment, the first working fluid 12 is methyl alcohol, while the second working fluid 22 is pure water. The heat pipe structure is applied to a heat source 4 in an environment with an environmental temperature under 0 degrees. With the environmental temperature under 0 degrees, the evaporation end 15 of the first tubular body 1 is contact with the heat source 4. The heat generated by the heat source 4 is conducted to the first working fluid 12 in the first tubular body 1. The first working fluid 12, which is methyl alcohol, is evaporated to carry away a great amount of heat from the heat source 4 in form of evaporation latent heat. The vapor of the first working fluid 12 is filled up in the vacuumed first receiving space 11. The vapor is condensed into liquid at the condensation end 16 to release heat. The liquid first working fluid 12 flows back to the evaporation section under the capillary attraction provided by the first capillary structure 14 for the next circulation of phase change. Accordingly, the vapor-liquid circulation of is continued to effectively transfer the heat generated by the heat source 4 to a remote end for heat exchange. This can avoid abrupt rise of temperature of the electronic device or relevant apparatus that needs heat dissipation.

When the heat pipe structure is in an environment with an environmental temperature under 0 degrees, the second working fluid 22 in the second tubular body 2, which is pure water, is solidified into ice. However, when the liquid-vapor circulation of the first working fluid 12 takes place, the temperature of the second working fluid 22 will gradually rise and the second working fluid 22 will restore into liquid phase. At this time, the second working fluid 22 is evaporated to carry away a great amount of heat from the heat source 4 in form of evaporation latent heat. The vapor of the second working fluid 22 is filled up in the vacuumed second receiving space 21. The vapor is condensed into liquid at the condensation end 16 to release heat. The liquid second working fluid 22 flows back to the evaporation section under the capillary attraction provided by the second capillary structure 24 for the next circulation of phase change. Accordingly, the vapor-liquid circulation of is continued to effectively transfer the heat generated by the heat source 4 to a remote end for heat exchange so as to achieve the object of heat transfer.

Accordingly, in a low-temperature condition, the first working fluid 12 of the heat pipe structure first transfers the heat. In a normal-temperature condition, the first and second working fluids 12, 22 both transfer the heat. In this case, the heat pipe structure can be activated at low temperature to operate at normal temperature to enhance the performance and avoid abrupt rise of temperature of the electronic device or relevant apparatus that needs heat dissipation. This solves the problem that the number of the heat pipes must be increased for achieving optimal heat dissipation effect. Moreover, the assembly applicability is enhanced to lower the assembling cost.

Figure 4:
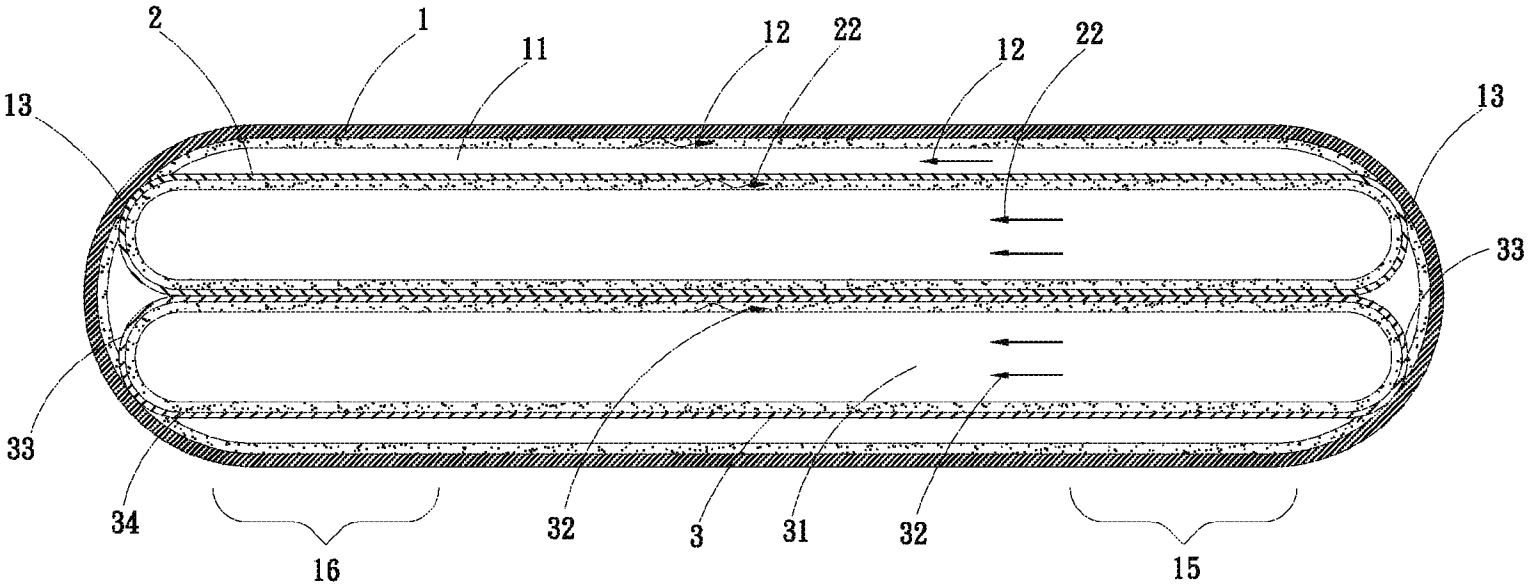
FIG. 4 is a longitudinal sectional view of a second embodiment of the present invention.
Figure 5:
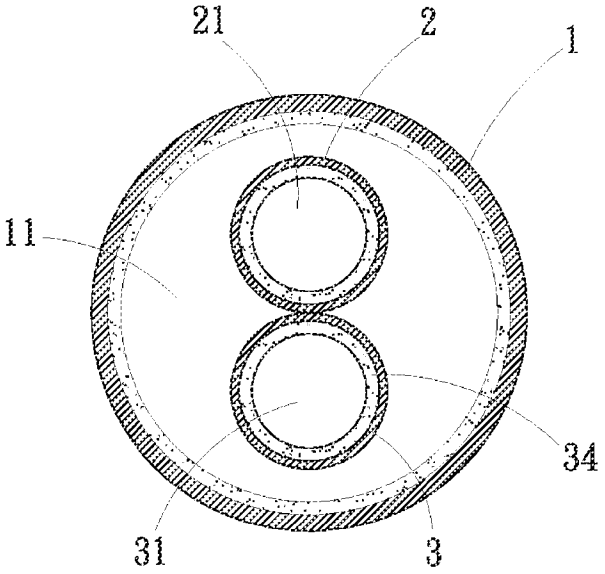
FIG. 5 is a cross-sectional view of the second embodiment of the present invention.

Please now refer to FIGS. 4 and 5. FIG. 4 is a longitudinal sectional view of a second embodiment of the present invention. FIG. 5 is a cross-sectional view of the second embodiment of the present invention. The second embodiment is partially identical to the first embodiment in structure and thus will not be repeatedly described. The second embodiment is different from the first embodiment in that the second embodiment further includes a third tubular body 3. The third tubular body 3 is disposed in the first receiving space 11. The third tubular body 3 has an internal third receiving space 31. A third working fluid 32 is contained in the third receiving space 31. Two ends of the third receiving space 31 are respectively two third closed ends 33, whereby the third receiving space 31 is a vacuumed space. The third closed ends 33 are formed in the first receiving space 11 and connected with the first closed ends 13. The third tubular body 3 has a third capillary structure 34. Two ends of the third capillary structure 34 and the first tubular body 1 together define the evaporation end 15 and the condensation end 16 respectively. The third capillary structure 34 is disposed on the inner wall face of the third tubular body 3.

The capillary structure 34 is selected from a group consisting of sintered powder bodies, channeled bodies, mesh bodies and coatings. In this embodiment, the third capillary structure 34 is, but not limited to, sintered powder body for illustration purposes only. In this embodiment, the third working fluid 32 is, but not limited to, one of pure water and methyl alcohol.

In the case that the third working fluid 32 is methyl alcohol, in an environment with an environmental temperature under 0 degrees, the third tubular body 3 together with the first and second tubular bodies 1, 2 can transfer heat. Accordingly, in a low-temperature condition, the first and third working fluids 12, 32 of the heat pipe structure first transfer the heat. In a normal-temperature condition, the first, the second and the third working fluids 12, 22, 32 all transfer the heat. In this case, the heat pipe structure can be activated at low temperature to operate at normal temperature to enhance the performance and avoid abrupt rise of temperature of the electronic device or relevant apparatus that needs heat dissipation. This solves the problem that the number of the heat pipes must be increased for achieving optimal heat dissipation effect. Moreover, the assembly applicability is enhanced to lower the assembling cost.

In the case that the third working fluid 32 is pure water, when the temperature of the third working fluid 32 rises and the third working fluid 32 restores to liquid phase, the third tubular body 3 together with the first and second tubular bodies 1, 2 can transfer heat. Therefore, in an environment with an environmental temperature under 0 degrees, the third tubular body 3 together with the first and second tubular bodies 1, 2 can transfer heat. Accordingly, in a low-temperature condition, the first working fluid 12 of the heat pipe structure first transfers the heat. In a normal-temperature condition, the first, the second and the third working fluids 12, 22, 32 all transfer the heat. In this case, the heat pipe structure can be activated at low temperature to operate at normal temperature to enhance the performance and avoid abrupt rise of temperature of the electronic device or relevant apparatus that needs heat dissipation. This solves the problem that the number of the heat pipes must be increased for achieving optimal heat dissipation effect. Moreover, the assembly applicability is enhanced to lower the assembling cost.

In conclusion, the heat pipe structure of the present invention can truly provide very good heat transfer effect.

The present invention has been described with the above embodiments thereof and it is understood that many changes and modifications in the above embodiments can be carried out without departing from the scope and the spirit of the invention that is intended to be limited only by the appended claims.

What is claimed is:

1. A heat pipe structure comprising:

a first closed tubular body having an internal first receiving space, a first working fluid being contained in the first receiving space, two ends of the first receiving space being respectively two first closed ends;

a second closed tubular body completely contained in the first receiving space in contact with and surrounded by said first working fluid, the second tubular body having an internal second receiving space, a second working fluid being contained in the second receiving space, two ends of the second receiving space being respectively two second closed ends;

a third tubular body disposed in the first receiving space, the third tubular body having a third receiving space, a third working fluid being contained in the third receiving space, two ends of the third receiving space being respectively two third closed ends;

wherein the third closed ends are formed in the first receiving space and connected with the first closed ends;

wherein the second and third tubular body's exterior surfaces are abutting each other; and wherein the solidification temperature of the first working fluid is lower than the solidification temperature of the second working fluid, so that the heat pipe structure can be activated at low temperature to keep operating at normal temperature.

2. The heat pipe structure as claimed in claim 1, wherein the second closed ends are formed in the first receiving space and connected with the first closed ends.

3. The heat pipe structure as claimed in claim 1, further comprising a first capillary structure disposed on inner wall face of the first tubular body, the first capillary structure being selected from a group consisting of sintered powder body, channeled body, mesh body and coating.

4. The heat pipe structure as claimed in claim 1, further comprising a second capillary structure disposed on inner wall face of the second tubular body, the second capillary structure being selected from a group consisting of sintered powder body, channeled body, mesh body and coating.

5. The heat pipe structure as claimed in claim 1, wherein the third tubular body further has a third capillary structure disposed on inner wall face of the third tubular body, the third capillary structure being selected from a group consisting of sintered powder body, channeled body, mesh body and coating.

6. The heat pipe structure as claimed in claim 5, wherein the third working fluid is one of pure water and methyl alcohol.

7. The heat pipe structure as claimed in claim 1, wherein the first working fluid is one of pure water and methyl alcohol, while the second working fluid is the other of pure water and methyl alcohol.

* * * * *